US005848815A

United States Patent [19]

Tsui et al.

[11] Patent Number: 5,848,815

[45] **Date of Patent: *Dec. 15, 1998**

[54] SAFETY HOIST RING

[75] Inventors: Gary Tsui, San Gabriel; Tony J. Alba, West Covina, both of Calif.

[73] Assignee: CBC Industries, Inc., City of Commerce, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 822,050

[22] Filed: Mar. 24, 1997

[51] Int. Cl.[6] ..... B66C 1/66

[52] U.S. Cl. ..... 294/1.1; 294/89; 403/78; 403/164

[58] Field of Search ..... 294/1.1, 82.1, 294/89; 403/78, 79, 164; 410/101, 112–114

[56] References Cited

U.S. PATENT DOCUMENTS

| | | | |
|---|---|---|---|
| 3,962,755 | 6/1976 | Buschini et al. | 294/82.1 |
| 4,429,526 | 2/1984 | Rehbein | 294/82.1 |
| 4,431,352 | 2/1984 | Andrews | 294/1.1 |
| 4,705,422 | 11/1987 | Tsui et al. | 294/1.1 |
| 4,863,205 | 9/1989 | Schron et al. | 294/89 |
| 5,352,056 | 10/1994 | Chandler | 294/82.1 |

*Primary Examiner*—Dean Kramer
*Attorney, Agent, or Firm*—Bruce A. Jagger

[57] ABSTRACT

For lifting loads there is provided an eyebolt with an annular ring swivelly mounted on a stud so as to freely rotate in a horizontal plane through a full 360 degrees. A lifting loop has oppositely disposed pivot pins in swivel engagement with the annular ring to allow the loop to pivot in a vertical arc as well as to rotate about the stud. The stud in turn is adapted to be anchored in fixed position to the load, whatever the load may be. Circumferential grooves are cut in the solid pivot pins adjacent the ends thereof. The pivot pins are received in a diametric bore in the retention ring. Bores in the body of the retention ring are positioned to align with the circumferential grooves. Solid dowel elements inserted in these bores engage with the circumferential grooves and retain the pivot pins assembled with the retention ring.

3 Claims, 2 Drawing Sheets

SAFETY HOIST RING

BACKGROUND OF THE INVENTION

1. Field of the Invention

The invention relates in general to safety hoist rings and, in particular, to safety hoist rings wherein the SOLID shoulder pins are retained in the retention ring by means of solid pins or dowels extending tangentially through annular grooves near the free ends of said shoulder pins.

2. Description of the Prior Art

Various safety hoist rings had been proposed previously. For example, in Tsui et al U.S. Pat. No. 4,705,422 a safety hoist ring was proposed which retained the shoulder pins in place by means of snap rings in grooves located adjacent the ends of the shoulder pins. While effective for smaller sizes of safety hoist rings, this arrangement was not satisfactory for large capacity hoist rings. For large hoist rings (for example, those with a load capacity in excess of 5 tons) so much of the metal in the retention ring had to be removed to accommodate the snap rings that the load carrying capacity of the safety hoist ring was impaired. Thus, oversized parts had to be used to achieve the desired load carrying capacity, an inefficient utilization of resources and an unnecessary cost. Further, the cost and difficulty of cutting the recesses in the retention ring to accommodate the snap rings added a significant cost to the production of the safety hoist rings.

Those concerned with these problems recognize the need for an improved shoulder pin retainer assembly in a safety hoist ring.

BRIEF SUMMARY OF THE INVENTION

A preferred embodiment of the safety hoist ring according to the present invention comprises a solid retention ring in which solid shoulder pins are retained by solid pins. The safety hoist rings according to the present invention are of the type in which a lifting loop pivots around the longitudinal as well as the diametric axis of the device. These safety hoist rings are adapted to be anchored to a load for lifting or securing that load. The safety hoist ring is capable of pivoting through a full 360 degree arc around the longitudinal axis. The extent of the lifting loops pivoting around the diametric axis is determined by the position of the load to which it is mounted. Where the safety hoist ring is mounted to a flat surface the lifting loop is generally free to pivot through an arc of about 180 degrees. The lifting loop is thus capable of positioning itself to accommodate a load which is applied from any direction.

In order to accommodate the assembly of the device and the necessary pivoting structure, the safety hoist ring is comprised of several parts. It has been found, according to the present invention, that safety, capacity and safety margin are substantially improved by providing a structure the parts of which, when assembled together, provide a substantially solid retention ring.

Other objects, advantages, and novel features of the present invention will become apparent from the following detailed description of the invention when considered in conjunction with the accompanying drawings.

BRIEF DESCRIPTION OF THE DRAWINGS

While the description which follows hereinafter is meant to be representative of a the invention, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration only and not limitation.

Figure 1:
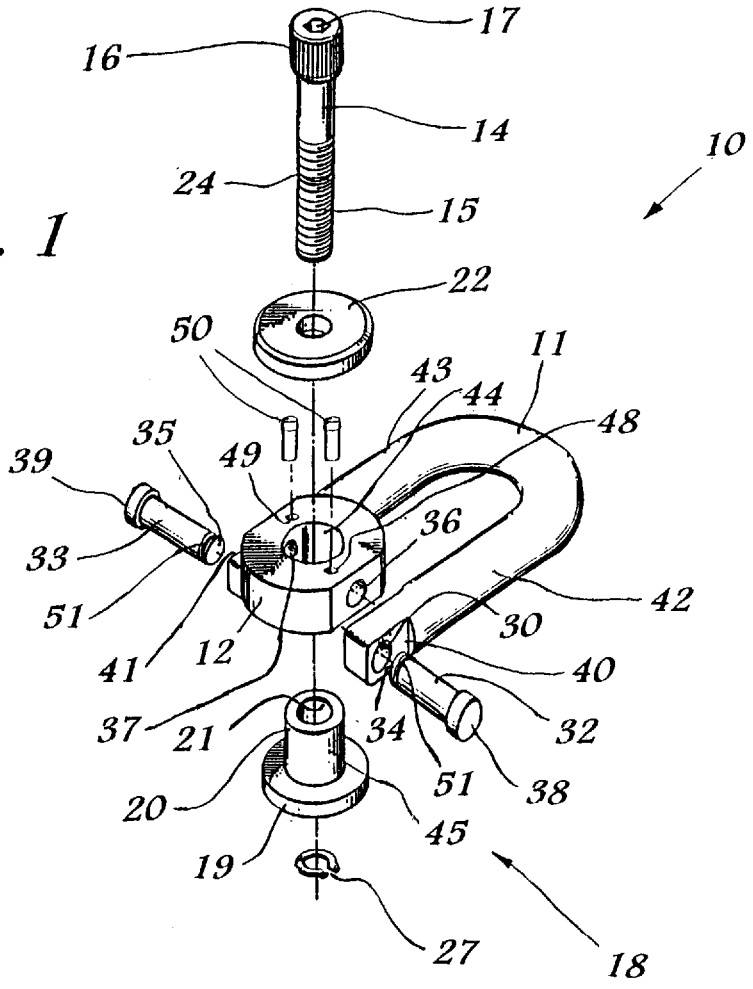
FIG. 1 is an exploded perspective view of an embodiment of the present invention.

In one embodiment of the safety hoist ring chosen for the purpose of illustration, there is shown what may aptly be described as a multi-position fixture consisting of a load-engaging anchor assembly, indicated generally by the reference character 10, upon which a lifting loop 11 is mounted and contained by use of a retention ring 12 in a fashion enabling the lifting loop to pivot throughout a vertical arc of 180 degrees around the diameter of the retention ring. The retention ring 12 is generally defined by substantially concentric generally cylindrical walls and generally laterally extending axially opposed faces. At the same time the retention ring, and consequently the lifting loop can swivel in a plane usually horizontal throughout a full 360 degrees around the longitudinal axis of the device.

The load-engaging anchor assembly 10 previously made reference to consists in part of the stud 14, the lower portion of which is a threaded shank 15, the upper end being provided with a head 16. To assist in tightening and loosening the stud from position, the exterior of the head may be knurled, as shown in FIG. 1, and also provided with a hexagonal recess 17 for reception of an appropriate conventional hexagonal wrench.

For cooperation with the stud 14, there is provided a bushing indicated generally at 18. The bushing is provided with a multipurpose flange 19, one purpose of which is to serve as a bearing for engagement with a load (not shown). Extending outwardly from the flange is a sleeve 20, the flange and sleeve 20 being provided with a central bore 21 through which the threaded shank 15 of the stud 14 extends.

The retention ring 12, previously identified, extends around the sleeve 20 in a snug rotational fit, and is held in position by a washer 22 beneath the head 16, serving as a retention member.

At the end of the sleeve 20 opposite from the washer 22 is a clip in the form of a snap ring 23 lodged in an annular groove 24 in the threaded shank 15. A recess on the underside of the flange 19 accommodates the snap ring in a position where it can clear an adjacent surface of a load to which the device is threadably attached. By providing the snap ring 23 as described, the operating parts are held in the necessary assembled relationship during shipment and handling, prior to being anchored to a load, the parts, therefore, not being easily mislaid.

Should there be need to disassemble the parts of the load-engaging anchor assembly, the snap ring 23, provided with an open side 27 as shown in the exploded view FIG. 1, can be expanded and removed.

The lifting loop 11, sometimes identified as a hoist ring, eyebolt, or U-bar, in order to provide an adequate safety factor, is preferably of forged steel. Shoulder pins 32 and 33 are provided and extend through diametric bores 30 and 31 at free ends of the legs 42 and 43 at the open end of the loop 11. Radially inwardly directed end faces 34 and 35 of the respective shoulder pins 32 and 33 are spaced from each other a distance something slightly in excess of the outside diameter of the sleeve 20. Just sufficient clearance so that the ends of the shoulder pins do not touch the sleeve 20 is preferred. For holding the shoulder pins in operative position, the ring member 12 is provided with diametrically opposite bores 36 and 37, the bores having a diameter slightly in excess of the diameter of the shoulder pins so that the pins are adapted to slide freely but snugly into the bores, the pins and bores being in axial alignment.

To improve the ease of manufacture and assurance of continued performance under exceptional conditions the shoulder pins 32 and 33 are anchored in the assembly by a special structural arrangement. The shoulder pins are assembled with respective heads 38 and 39 in snug engagement with outside surfaces 40, 41 of the legs 42, 43 of the loop 11. Free ends of the shoulder pins are substantially coincident with an annular inside wall 44 of the retention ring 12. In this position the end faces 34, 35 comfortably clear the exterior wall 45 of the sleeve 20.

For anchoring the shoulder pins 32, 33 in the assembly, bores 48 and 49 are cut into the retention ring 12 tangential with the location of the respective bores 36 and 37. Solid dowel elements 50, 50 are force fit in bores 48, 49. The bores 48, 49 having a diameter which is slightly less than the diameter of dowel elements 50. The bores 48, 49 are generally aligned axially with but offset from the longitudinal axis of the retention ring 12. Annular grooves 51 in the respective shoulder pins adjacent the free ends thereof accommodate the respective solid dowel elements.

When assembling the parts, the solid dowel elements 50, 50, and the retention ring 12 are effectively rotatably trapped in the assembled condition between multi-purpose flange 19 and washer 22. It is also of consequence to note that the length of the sleeve 20 is slightly in excess of the thickness of the retention ring 12 so that the bearing flange 19 cannot be drawn into binding engagement with the retention ring when the stud 14 draws the flange 19 snugly against the surface of a load. With this arrangement the retention ring, although captive, remains free to swivel its full 360 degrees, enabling the lifting loop 11 likewise to swivel the full 360 degrees, while at the same time being capable of pivoting at its free ends about the axis of the shoulder pins 32 and 33.

Wherever there is need to disassemble the parts of the load-engaging anchor assembly, the clip 23, provided as shown with an open side 27, as shown in the exploded view, FIG. 1, can be expanded and removed from groove 24.

Figure 2:
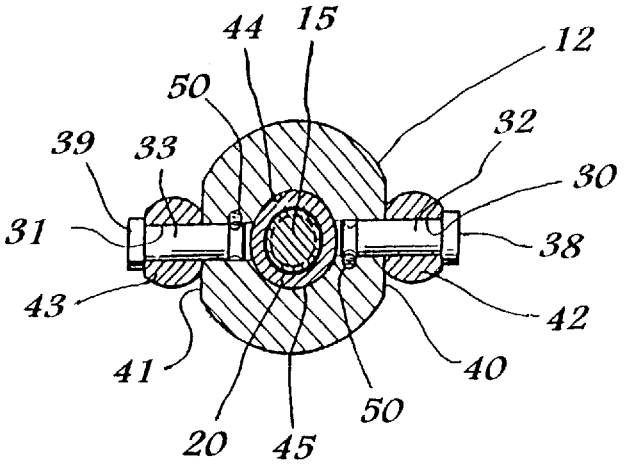
FIG. 2 is a cross sectional view of the embodiment of FIG. 1 taken along a diameter of the device.
Figure 3:
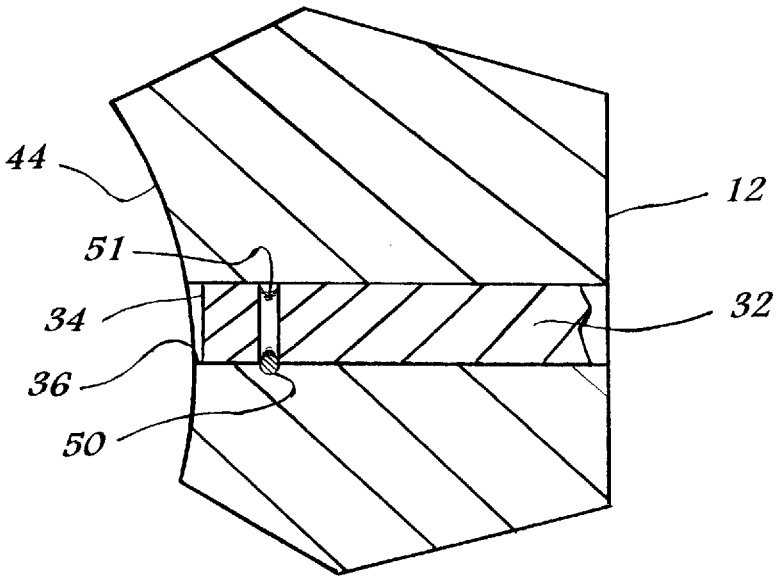
FIG. 3 is a partial cross-sectional view of the retention ring in the assembled configuration showing the solid nature of the assembly.

Of still greater consequence are the bores 48 and 49 accommodating as they do the solid dowel elements 50, 50 and their respective annular grooves in the corresponding shoulder pins 32, 33. With Applicants' arrangement, the shoulder pins can be merely pushed into place without need for rotary orientation. The solid dowel elements are forced into the bores and driven home for any position of rotation of the shoulder pins. As illustrated particularly in FIGS. 2 and 3, the retention ring, in the assembled configuration, is virtually a solid block composed of several different parts. This contributes significantly to the strength and safety of this device. The solid dowels 50, 50 add extra security against the dislodgement of the pins 32 and 33 under heavy loads.

While a particular embodiment of the invention has been shown and described, it will be obvious to those skilled in the art that changes and modifications may be made without departing from the invention in its broader aspects, and therefore the aim of its appended claims is to cover all such changes and modifications as fall within the true spirit and scope of the invention.

What is claimed is:

1. A safety hoist ring for attachment to a load, said safety hoist ring comprising a load engaging structure, a retention ring having a captive swivel engagement with said load engaging structure and adapted to rotate throughout substantially a full circle, a lifting loop, and a transversely disposed pivot structure, said transversely disposed pivot structure including opposed solid pivot pin elements respectively pivotally joined to said lifting loop in a fixed spaced axial relationship with respect to each other, each said solid pivot pin element having a captive end at a pivotal junction with the lifting loop and a free end, said retention ring comprising a ring member having axially opposed faces, and a diametric bore extending laterally therethrough, said solid pivot pin elements being received in and substantially filing said diametric bore, each of said solid pivot pin elements including a groove extending circumferentially adjacent the free end thereof, said retention ring including a detent receiving bore intersecting with each of said respective grooves, a solid detent member received in each of said detent receiving bores and engaged with said respective grooves, said detent receiving bores being disposed on opposite sides of said diametric bore.

2. A safety hoist ring as in claim 1 wherein there is substantially no void space in the retention ring in the assembled configuration.

3. A safety hoist ring for attachment to a load, said safety hoist ring comprising a load engaging structure, a retention ring having a captive swivel engagement with said load engaging structure and adapted to rotate throughout substantially a full circle, a lifting loop, and a transversely disposed pivot structure, said transversely disposed pivot structure including opposed solid pivot pin elements respectively pivotally joined to said lifting loop in a fixed spaced axial relationship with respect to each other, said lifting loop being mounted for pivotal movement through a vertical arc about the diameter of said circle, each said solid pivot pin element having a captive end at a pivotal junction with the lifting loop and a free end, said retention ring comprising a ring member having axially opposed faces, and a diametric bore extending laterally therethrough, said solid pivot pin elements being received in and substantially filing said diametric bore, each of said solid pivot pin elements including a groove extending circumferentially adjacent the free end thereof, said retention ring including a detent receiving bore intersecting with each of said respective grooves, a detent member received in each of said detent receiving bores and engaged with said respective grooves, said detent receiving bores being disposed on opposite sides of said diametric bore.

* * * * *